US006908190B2

(12) United States Patent
Iwatsuki et al.

(10) Patent No.: US 6,908,190 B2
(45) Date of Patent: Jun. 21, 2005

(54) PLATEN DEVICE FOR HOLDING WORKPIECE IN INK-JET PRINTER

(75) Inventors: Kazuaki Iwatsuki, Aichi-ken (JP); Katsunori Nakashima, Nagoya (JP); Takeshi Kimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 66 days.

(21) Appl. No.: 10/420,424

(22) Filed: Apr. 22, 2003

(65) Prior Publication Data

US 2003/0197772 A1 Oct. 23, 2003

(30) Foreign Application Priority Data

Apr. 23, 2002 (JP) ..... 2002-121280

(51) Int. Cl.[7] ..... B41F 1/38
(52) U.S. Cl. ..... 347/104; 101/474; 400/48
(58) Field of Search ..... 347/4, 104; 101/41, 101/42, 114, 115, 474; 400/23, 48; 38/16, 102.1, 102.2; 160/380, 381

(56) References Cited

U.S. PATENT DOCUMENTS 4,451,997 A * 6/1984 Jones ..... 38/102.2
4,708,057 A * 11/1987 Hogenson ..... 101/129
5,664,350 A * 9/1997 Moore, III ..... 38/102.2
5,934,210 A * 8/1999 Lucchese ..... 112/103
6,095,628 A 8/2000 Rhome ..... 347/4
6,631,985 B2 * 10/2003 Koizumi et al. ..... 347/101

FOREIGN PATENT DOCUMENTS

JP 5-84887 4/1993
JP 11-227171 8/1999

* cited by examiner

*Primary Examiner*—Lamson Nguyen
*Assistant Examiner*—Blaise Mouttet
(74) *Attorney, Agent, or Firm*—Pitney Hardin LLP

(57) ABSTRACT

A platen device for holding a workpiece in an ink-jet printer operable to perform a printing operation on a printing surface of the workpiece, said platen device being movable into a printing area in which a printing head is operated to deliver an ink onto said printing surface for thereby forming an image on said printing surface, the platen device including a platen arranged to permit the workpiece to be placed on the platen such that a printing portion of the workpiece having the printing surface is in direct contact with a surface of the platen, and a space-defining structure partially defining an accommodating space which is provided below the platen to accommodate non-printing portions of the workpiece which extend from the printing portion outwardly of the platen.

25 Claims, 8 Drawing Sheets

PLATEN DEVICE FOR HOLDING WORKPIECE IN INK-JET PRINTER

The present application is based on Japanese Patent Application No. 2002-121280 filed Apr. 23, 2002, the content of which is incorporated herein by reference.

BACKGROUND OF THE INVENTION

1. Field of the Invention

The present invention relates to a platen device of an ink-jet printer, which is arranged to hold a work fabric or other workpiece, such as a T-shirt, during a printing operation on the workpiece.

2. Discussion of Related Art

A silk-screen printer is conventionally used to print a desired image on a work fabric before the printed work fabric is cut and stitched into a desired garment. For instance, the printed fabric is cut and stitched into a T-shirt such that the printed image is located in the front (bosom) or the back of the T-shirt. The printing method using the silk-screen printer is suitable for a relatively large lot production of a relatively small number of kinds of garments in factories, but is not suitable for a relatively small lot production of a relatively large number of kinds of garments which have different unique patterns of printed image desired or selected by the users or consumers.

In view of the above-indicated drawback of the silk-screen printing on work fabrics, various methods of printing desired patterns of image on unprinted garments or cloths have been proposed for producing a relatively wide variety of printed garments in a relatively small lot size. For personal and household printing of unprinted garments, it has been a common practice, for example, to first prepare an intermediate printing medium having an image, and then transfer the image from the medium onto an unprinted garment such that the medium and the unprinted garment are superposed on each other and subjected to a heat and/or pressure for facilitating the transfer of the image from the medium onto the unprinted garment and fixing the image on the garment. The intermediate printing medium is typically a decalcomania paper carrying an image formed by copying or printing with a transferable material, or a special paper carrying an image formed by copying or printing with a transferable toner or ink.

For industrial production of a relatively large number of kinds of printed garments from unprinted garments or cloths in a relatively small lot size, it has been proposed to use a specially designed printer which is connected to a personal computer and operable to print desired patterns of image on unprinted T-shirts or other unprinted garments according to image data stored in a memory of the personal computer. JP-A-5-84887 discloses an example of this type of printer, which has a table provided with an ink jetting device which is fixed on the table and operable to deliver an ink directly on the surface of an unprinted garment held on the table. The ink jetting device includes a printing head which is movable in two mutually perpendicular directions on the unprinted garment, to print the image with the delivered ink.

JP-A-11-227171 discloses an example of a printing device which has an upper belt and a lower belt which cooperate to hold and feed an unprinted garment such as a T-shirt, and a printing head which is movable in a direction perpendicular to the feeding direction of the unprinted garment and operable to deliver an ink on the unprinted garment.

In the printer disclosed in the above-identified publication JP-A-5-84887, the table is provided with a frame arranged to hold the T-shirt or other unprinted garment on the table such that the front and back of the T-shirt, for example, are superposed on each other, that is, two layers of the T-shirt fabric are held in direct contact with each other. In this state, the upper fabric layer (e.g., the front or bosom of the T-shirt) is relatively likely to float away from the lower fabric layer (e.g., the back of the T-shirt) and have some crease. The publication proposes a solution to this problem, namely, proposes to provide a plurality of sensors for detecting distances between the upper surface of the unprinted garment and respective ink heads of the ink jetting device which correspond to respective different colors. The vertical positions of the ink heads are automatically adjusted according to the detected distances, so that the distances of the ink heads to the upper surface of the garment are held constant. However, this arrangement suffers from another problem of increased complexity in the construction and control of the printer.

Where an ink is delivered on the mutually superposed two layers of fabric of the unprinted garment such as the T-shirt, the ink may undesirably permeate through the upper fabric layer into the lower fabric layer, if the fabric has a relatively small thickness or a relatively coarse texture, or if the ink has a relatively low viscosity. The printer using the frame has a further problem that the unprinted garment must be carefully set on the frame such that non-printing portions of the garment such as the sleeves and hem or lower portions are neatly placed on the upper surface of the table, so as to prevent an interference of those non-printing portions with movable components such as the ink heads, that is, so as to prevent the non-printing portions of the garment from being an obstacle to the movable components. The printer in question has another problem due to similar or equal tensioning of the garment held by the frame in all directions irrespective of the direction of weaving of the fabric. Namely, if the fabric of the garment is printed while the fabric held by the frame is elongated in the direction in which the fabric is relatively easily elongated, the image printed on the fabric may deform due to shrinkage of the fabric to the original state after the fabric is removed from the frame.

In the printing device disclosed in the above-identified publication JP-A-11-227171, the ink is delivered onto the garment such as the T-shirt through an opening formed in the upper belt during feeding of the garment while the garment is held in a generally horizontally extending attitude by and between the upper and lower belts, with the upper and lower fabric layers being superposed on each other. Accordingly, like the printer using the frame, the printer using the upper and lower belts may also suffer from undesirable permeation of the ink through the upper fabric layer into the lower fabric layer. Further, this printer tends to be large-sized.

SUMMARY OF THE INVENTION

It is therefore a principal object of the present invention to provide a platen device for holding a workpiece in an ink-jet printer for printing the workpiece, which platen device is constructed to facilitate setting of a workpiece, and minimize permeation of an ink through an upper layer of a printing portion of the workpiece into a lower layer thereof, and an interference of non-printing portions of the workpiece with movable components of the printer.

This object may be achieved according to the principle of the present invention, which provides a platen device for holding a workpiece in an ink-jet printer operable to perform a printing operation on a printing surface of the workpiece, the platen device being movable into a printing area in which a printing head is operated to deliver an ink onto the printing surface for thereby forming an image on the printing surface, the platen device comprising:

a platen arranged to permit the workpiece to be placed on the platen such that a printing portion of the workpiece having the printing surface is in direct contact with a surface of the platen; and a space-defining structure partially defining an accommodating space which is provided below the platen to accommodate non-printing portions of the workpiece which extend from the printing portion outwardly of the platen.

The platen device constructed according to the present invention permits easy setting of the workpiece, owing to the provision of the accommodating space provided below the platen to accommodate the non-printing portions of the workpiece. Where the workpiece is a tubular work fabric such as a T-shirt or sleeveless shirt, for example, the printing portion of the tubular work fabric (e.g., front portion of a T-shirt) is placed on the platen, while the non-printing portions (such as back portion and sleeves of the T-shirt) extending outwardly from the printing portion in contact with the platen are accommodated in the accommodating space. Since only the printing portion of the workpiece is held in direct contact with the surface of the platen while the other or non-printing portions of the workpiece are accommodated in the accommodating space, the ink delivered from the printing head does not stain the non-printing portions. In addition, the accommodating space provided to accommodate the non-printing portions of the workpiece prevents the non-printing portions from interfering with any movable portions of the ink-jet printer such as the printing head, thereby preventing the non-printing portions from being stained or disturbing a printing operation performed by the printing head on the printing surface of the printing portion.

According to a first preferred form of the platen device of the invention, the space-defining structure partially defines the accommodating space such that the accommodating space can accommodate a part of a non-printing portion of the workpiece which extends from the printing portion in direct contact with the surface of the platen and which cooperates with the printing portion to form a tubular portion of the workpiece, and the platen is arranged to permit the workpiece to be positioned relative to the platen and the accommodating space such that the above-indicated part of the non-printing portion is spaced by at least the platen from the printing portion in a direction of thickness of the platen. For instance, the platen device includes a support structure which supports the platen in a cantilever fashion such that the platen is supported at one end portion thereof on the side of the printing area of the printer and is not supported at the other end portion.

The space-defining structure and the platen in the above-described preferred form of the platen device make it possible to set the tubular workpiece such that the part of the non-printing portion of the workpiece accommodated in the accommodating space is spaced by the platen from the printing portion placed in contact with the platen, so that the non-printing portion, in particular, the part of the non-printing portion within the accommodating space is effectively prevented from being stained by the ink delivered to the printing portion. Thus, the prior art problem of permeation of the ink through the front portion of a tubular workpiece into the back portion superposed on the front portion can be effectively avoided in the present platen device.

It is to be understood that the present platen device can hold any kind of workpiece including a non-annular or non-tubular workpiece as well as a tubular workpiece, such that a portion of the workpiece which has a printing surface area is held in direct contact with the upper surface of the platen. It is also to be understood that the platen device of the present invention can hold any tubular workpiece other than a T-shirt, for example, a sleeveless shirt, a cap and a hat. The term "tubular workpiece" is interpreted to mean a workpiece (e.g., work fabric) including at least one annular or tubular portion, such as a body portion (including front and back portions) and sleeves of the T-shirt. It is also noted that a non-tubular workpiece such as an apron includes a tubular portion such as a pocket which includes at least two fabric layers. It is further noted that the platen device of the present invention can be used to hold such a tubular portion of the non-tubular workpiece, and that the workpiece need not be a fabric, and may be formed of any material that accepts an ink. It is also noted that the platen has a straight surface or a convex or concave surface, for contact with the printing portion of the workpiece.

The platen device according to a second preferred form of the invention further comprises a frame structure cooperating with the platen to hold the workpiece while applying a tension to the printing portion of the workpiece.

In the platen device according to the second preferred form of the invention, the printing portion of the workpiece can be set on the platen without a crease or slack, owing to the tension applied to the printing portion by the frame structure and the platen.

According to one advantageous arrangement of the above-described second preferred form of the invention, the platen device further comprises a base on which the platen is fixedly disposed, and the frame structure includes an outer frame pivotally connected to the base at one end of the base, such that the outer frame is pivotable so that the frame structure is pivotable between an open position and a closed position, the frame structure further including an inner frame disposed inside the outer frame and pivotable relative to the outer frame, the frame structure and the platen being positioned relative to each other such that the inner frame comes into contact with the printing portion of the workpiece when the frame structure is pivoted to the closed position.

The frame structure constructed as described above permits uniform application of a holding force to the printing portion of the workpiece and even holding of the workpiece, by the inner frame in cooperation with the platen, owing to a free pivotal movement of the inner frame relative to the outer frame when the frame structure is pivoted to the closed position. Accordingly, the present frame structure assures even tensioning of the printing portion over the entire area of the printing surface, without a crease, local upward protrusion or floating or slackening of the printing surface.

Where the frame structure includes the inner and outer frames arranged as described above, the frame structure and the platen are preferably positioned relative to each other such that an upper surface of the frame structure is spaced apart from the upper surface of the platen in a direction away from a surface of the printing head from which the ink is delivered, when the frame structure is placed in the closed position in which the frame structure cooperates with the platen to hold the workpiece.

In the preferred arrangement of the frame structure of the platen described above, the workpiece can be effectively tensioned by downward pivoting of the frame structure, more specifically, by a downward movement the inner frame relative to the platen to a position at which the upper surface of the frame structure is located below the upper surface of the platen. As a result of this movement downward of the inner frame, a force acts on the workpiece adjacent to the periphery of the printing portion in contact with the platen, in the downward direction, so that the printing portion can be tensioned. In addition, the frame structure in its closed position does not interfere with the ink delivery surface of the printing head, and does not limit an area of the printing portion of the workpiece in which an image can be formed by the printing head with a relative movement between the printing head and the platen on which the printing portion is held by the frame structure.

Where the frame structure includes the inner and outer frames arranged as described above, the inner frame is preferably provided with an abutting portion which comes into contact with the workpiece when the frame structure is pivoted to the closed position. The abutting portion may be absent at each corner portion of the inner frame.

The abutting portion contacts the workpiece at its parts adjacent to the periphery of the platen, except at the corner portions of the platen. Accordingly, the abutting portion is effective to prevent application of an excessive tension to the parts of the workpiece adjacent to the corner portions of the platen, which would cause creasing of the workpiece at the corner portions.

The abutting portion may consist of at least three elongate presser members which extend along respective sides of the inner frame, for example, four straight presser bars extending along respective four sides of the inner frame, where the inner frame is a rectangular frame. However, the abutting portion need not be constituted by members in the form of elongate members.

Where the inner frame of the frame structure is provided with the abutting portion, the space-defining structure preferably includes an auxiliary plate which is disposed below the platen and which partially defines the accommodating space on one side thereof remote from the platen. In this case, the abutting portion presses the workpiece against a surface of the auxiliary plate when the frame structure is pivoted to the closed position.

In the platen device provided with the auxiliary plate which partially defines the accommodating space, the frame structure does not exert an unnecessarily large force directly on the printing portion of the workpiece in contact with the platen, but is arranged such that the abutting portion of the inner frame presses the parts of the workpiece adjacent to the periphery of the printing portion against the surface of the auxiliary plate, thus applying a tension to the printing portion evenly over the entire printing surface area in contact with the surface of the platen.

The auxiliary plate may be fixed to the platen such that the platen and the auxiliary plate constitute a unitary assembly. The auxiliary plate may be suspended from the fixed platen, or the fixed auxiliary plate may support the platen. The auxiliary plate may have a generally pentagonal outer shape defined by five generally straight sides including two mutually adjacent sides which are inclined relative to each other so as to define an apex portion which has an obtuse angle and which is located at one end of the auxiliary plate as seen in a direction of movement of the platen device relative to the printing head. The above-indicated one end of the auxiliary plate is remote from the printing area in the direction of movement of the platen. The space-defining structure may further includes a tray which cooperates with the auxiliary plate to define the accommodating space therebetween. The tray may have opposite side walls which extend in a direction of thickness of the platen and the auxiliary plate and which define a width of the accommodating space as measured in a direction perpendicular to the direction of thickness and a direction of movement of the platen device relative to the printing head.

Any of the above-indicated features, namely, (a) the unitary assembly of the platen and the auxiliary plate, (b) the generally pentagonal auxiliary plate having the apex portion and (c) the tray cooperating with the auxiliary plate to define the accommodating space, facilitates setting of a tubular workpiece such as a T-shirt, by moving the tubular workpiece relative to the platen and the auxiliary plate, so as to insert the platen and auxiliary plate into a tubular portion of the tubular workpiece, such that the printing portion of the tubular portion is set in contact with the surface of the platen while a part of the other or non-printing portions of the tubular workpiece are accommodated in the accommodating space. Thus, each of the above-indicated features which are optionally incorporated in the platen device facilitates the setting of the printing portion of the tubular workpiece such that any of the non-printing portions is not superposed on the printing portion placed in contact with the platen.

Where the auxiliary plate has a generally pentagonal shape and an apex portion, as described above, the apex portion functions as a positioning reference, which can be conveniently used to position the workpiece while the tubular workpiece is moved relative to the platen and auxiliary plate for setting the workpiece, and after the workpiece is roughly fitted on the platen and auxiliary plate.

Where the tray having the two side walls is provided, the non-printing portions of the workpiece extending from the printing portion in contact with the platen can be suitably accommodated within the accommodating space partially defined by the tray the side walls of which prevent the accommodated non-printing portions from moving out of the accommodating space. Thus, the tray is effective to prevent the non-printing portions of the workpiece from interfering with any movable components of the ink-jet printer or disturbing a printing operation performed by the printing head.

The auxiliary plate preferably has a gripping portion which is provided on the surface and which cooperates with the abutting portion to grip a part of the workpiece, when the frame structure is pivoted to the closed position. In this case, the part of the workpiece gripped by the gripping portion and the abutting portion is located outside the surface of the platen.

The gripping portion of the auxiliary plate which cooperates with the abutting portion of the inner frame of the frame structure to grip the workpiece is effective to apply a suitable tension to the printing portion of the workpiece in a direction in which the workpiece is relatively less expandable and shrinkable, for example, in the direction of length of a T-shirt.

The gripping portion of the auxiliary plate may consist of elongate gripper members provided at opposite end portions of the surface of the auxiliary plate, which opposite end portions are spaced apart from each other in a direction of movement of the platen device relative to the printing head. In this case, the frame structure is pivotable at one end thereof as seen in the direction of movement of the platen device. However, the gripping portion need not be constituted by elongate members, but may take any other form and may be formed of any material, provided the gripping portion is capable of cooperating with the abutting portion to grip the selected part of the workpiece, to apply a suitable tension to the printing portion of the workpiece.

The abutting portion of the inner frame and the gripping portion of the auxiliary plate desirably have a higher coefficient of friction than those of the platen and the auxiliary plate. To this end, the platen, the frame structure and the auxiliary plate may be formed of aluminum and finished by a surface treatment by plating, for instance. This arrangement permits a smooth movement of the workpiece relative to the platen and auxiliary plate, and application of a workpiece gripping force in the downward direction so as to suitably tension the printing portion of the workpiece in pressing contact with the platen.

The platen device may further comprise an adjusting mechanism arranged to adjust a relative position between the elongate presser members and the elongate gripper members described above, in the direction of movement of the platen device, for adjusting a tension to be applied to the printing portion of the workpiece depending upon the thickness, material and other properties of the workpiece.

The platen preferably has chamfered corner portions partially defined by the surface thereof for contact with the printing portion of the workpiece. The chamfering of the corner portions of the platen prevents application of uneven tensile forces to the corner portions of the platen, which would cause creasing or local floating of the workpiece at the corner portions of the platen.

According to a further preferred form of the platen device of this invention, the platen constitutes a part of a unitary assembly, and the space-defining structure includes the unitary assembly and a lower member which is disposed below the unitary assembly and which cooperates with the unitary assembly to define the accommodating space. The unitary assembly has a surface which is located below and outwardly of the surface of the platen and which supports one of the non-printing portions of the workpiece which is located adjacent to the printing portion. The unitary assembly may consist of the platen, and the auxiliary plate described above.

In one advantageous arrangement of the above preferred form of the platen device, the lower member is a tray having opposite side walls which extend in a direction of thickness of the unitary assembly and which define a width of the accommodating space as measured in a direction perpendicular to the direction of thickness and a direction of movement of the platen device relative to the printing device. The width of the accommodating space is larger than a width of the unitary assembly.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Figure 1:
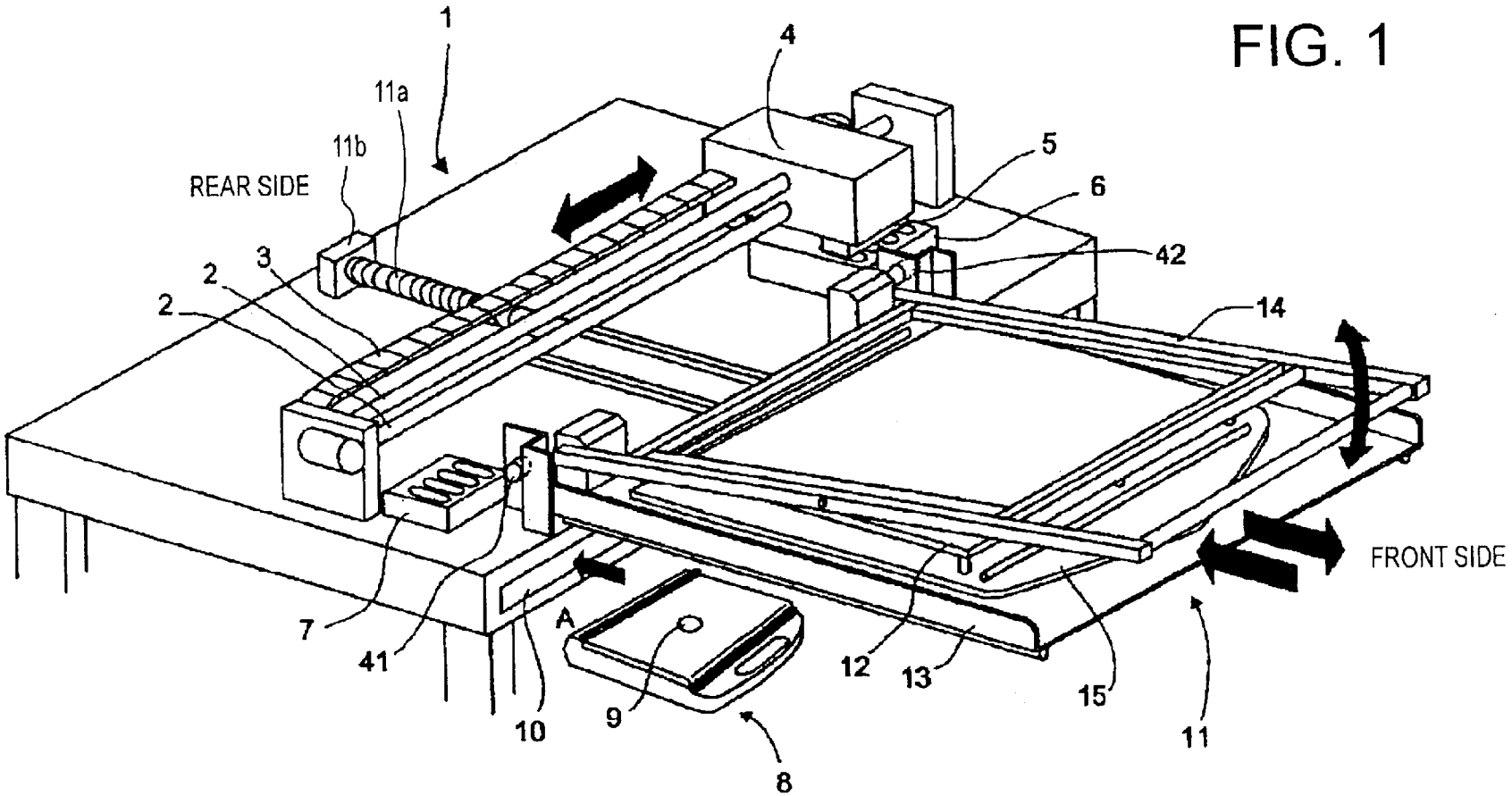
FIG. 1 is a perspective view schematically showing an ink-jet printer provided with a platen device according to one embodiment of this invention.

Referring to FIGS. 1–8, one preferred embodiment of the present invention will be described. Reference is first made to the perspective view of FIG. 1 schematically showing an arrangement of an ink-jet printer which is operable to perform a printing operation on a workpiece in the form of a work fabric and which is provided with a platen device constructed to hold the work fabric.

The ink-jet printer, which is indicated generally at 1, has a main body portion including: a carriage 4 carrying a printing head 5 and an ink cartridge (not shown); two guide shafts 2 supporting the carriage 4 such that the carriage 4 is slidably reciprocable in a primary scanning direction, namely, in a lateral direction of the printer 1; a drive belt 3 connected to the carriage 4 and driven by a drive source (not shown) to reciprocate the carriage 4; a cleaning unit 6 disposed at a right end of a reciprocating stroke of the carriage 4 (printing head 5) and operable to clean the printing head 5 at a predetermined time interval when the printing head 5 is located at its initial or home position, that is, at the right end of its reciprocating stroke; a flushing unit 7 disposed at a left end of the reciprocating stroke of the carriage 4 and operable to flush the printing head 5, for discharging a remaining amount of an ink from the printing head 5 when the printing head 5 is located at the left end of its reciprocating stroke; a waste-ink reservoir 8 having an opening 9 and provided to accommodate a waste ink which is discharged from the printing head 5 through the cleaning and flushing units 6, 7 and which is received through the opening 9; and a receptacle 10 in which the waste-ink reservoir 8 is set at a predetermined position to receive the waste ink. Although the carriage 4 is slidably supported and guided by the two guide shafts 2 in the present embodiment, only one guide shaft or three or more guide shafts may be used to slidably support and guide the carriage 4.

The ink-jet printer 1 further has a platen device 11 including: a platen 12 on which the work fabric in the form of a T-shirt 32 (FIGS. 4A–4D) is placed; an auxiliary plate 15 provided to guide and hold the T-shirt 32 or other annular or tubular work fabric; a lower member in the form of a tray 13 provided to accommodate non-printing portions of the tubular work fabric, which extend downwards from a printing portion placed in contact with the upper surface of the platen 12, as described below; and a frame structure 14 arranged to hold the work fabric on the platen 12, namely, cooperating with the platen 12 and the auxiliary plate 15 to hold the work fabric to be printed by the printing head 5. As described below, the auxiliary plate 15 and the tray 13 cooperate to define therebetween an accommodating space 13*a* (FIGS. 3 and 4C) for accommodating the downwardly extending non-printing portions of the tubular work fabric such as the T-shirt 32. It will be understood that the tray 13 and the auxiliary plate 15 constitute a space-defining structure which partially defines said accommodating space 13*a* provided below the platen 12 to accommodate non-printing portions of a workpiece which extend from the printing portion of the workpiece outwardly of the platen 12.

Before describing the platen device 11 in detail, an operation of the ink-jet printer 1 will be briefly described. When the printer 1 is not in operation, the platen device 11 is located at its rest position or printing-start position. At this rest or printing-start position, the platen device 11 is located on the main body of the printer 1. When a work-setting switch (not shown) is turned on, the platen device 11 is slidably moved on the upper surface of a table of the main body of the printer 11, from the rest position to a work-setting position (position shown in FIG. 1), by an operation of a drive source (not shown) which is operatively connected to the platen device 11 through a feedscrew 11*a* fixed to the platen device 11, and a nut 11*b* which is fixed on the table and held in engagement with the feedscrew 11*a*. Then, the operator of the ink-jet printer 1 places the platen device 11 in its open position, by upwardly pivoting the frame structure 14, sets the work fabric on the platen 12 as described below more specifically, and closes the platen device 11 by downwardly pivoting the frame structure 14, so as to hold the work fabric. The portions of the work fabric extending outwardly from the frame structure 14 are accommodated within the tray 13 disposed under the platen 12 and auxiliary plate 15, that is, within the space 13*a*, so that these portions (non-printing portions) of the work fabric are prevented from interfering with movable components of the ink-jet printer 1, such as the printing head 5, and are therefore prevented from being stained during a printing operation on the printing portion placed on the platen 12.

When a printing-start switch (not shown) is then turned on, the platen device 11 with the work fabric set thereon is slidably moved from the work-setting position to the printing-start position on the table of the printer 1. With the platen device 11 located at the printing-start position, a printing operation by the printing head 6 is initiated with a reciprocating movement of the carriage 4 with the printing head 5 by the drive belt 3 in the primary scanning direction. During the movement of the carriage 4, an ink is delivered from nozzles of the printing head 5, at selected spots in the primary scanning direction. After completion of one reciprocating movement of the carriage 4, the platen device 11 is fed by a predetermined incremental distance toward the work-setting position, that is, in a secondary scanning direction perpendicular to the primary scanning direction, and the next printing operation of the printing head 5 in the primary scanning direction is initiated. The printing operations in the primary scanning direction are repeatedly performed, so that a desired pattern of image is printed on the portion of the work fabric which is in contact with the upper surface of the platen 12. The manner of the printing operations of the printing head 5 is not limited to the specific one described above, but may be suitably modified. For instance, the incremental feeding of the platen device 11 in the secondary scanning direction may be effected each time the printing head 5 has been moved to each of the opposite right and left ends of its moving stroke.

The printing head 5 has a plurality of nozzles corresponding to respective different colors of ink, and a plurality of ink cartridges corresponding to the respective colors. The ink is fed from each ink cartridge to the corresponding nozzle through an ink supply passage. The waste ink discharged or sucked out from the printing head 5 by the cleaning unit 6, and the waste ink discharged from the printing head 5 by flushing thereof by the flushing unit 7 are directed to the opening 9 of the waste-ink reservoir 8 set in the receptacle 10, through respective discharge passages (not shown), and respective outlet tubes (not shown) which are open at positions right above the opening 9 of the reservoir 8 suitably positioned in the receptacle 10.

Figure 2:
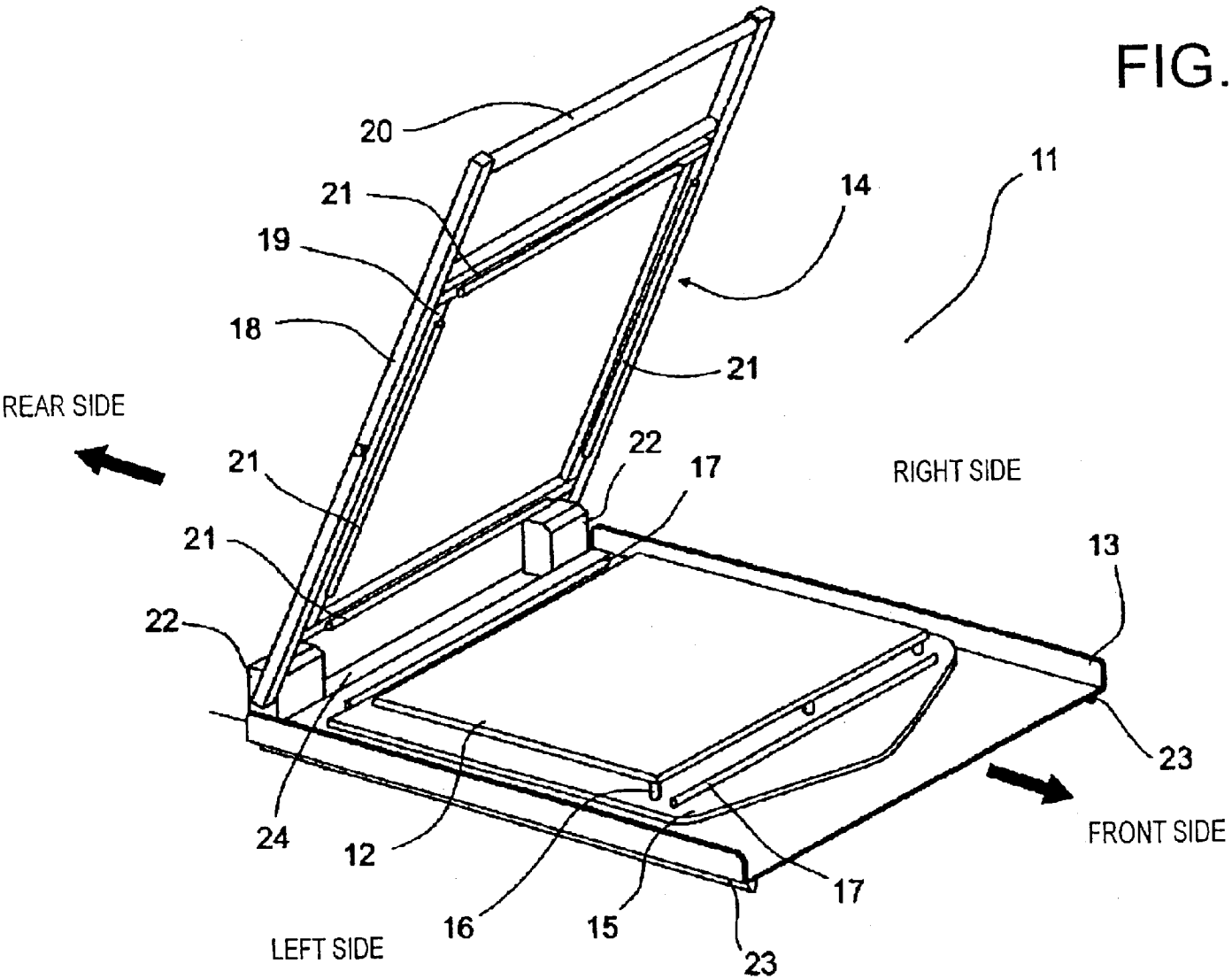
FIG. 2 is a perspective view of the platen device.

The structural arrangement of the platen device 11 will be described in greater detail by reference to the perspective view of FIG. 2, and the left side elevational view of FIG. 3. It is noted that the right and left sides as seen in FIG. 2 will be referred to as the front and rear sides of the printer 1 and platen device 11, respectively, while the left lower side and the right upper side as seen in FIG. 2 will be referred to as the left and right sides of the printer 1 and platen device 11, respectively. The work fabric is set on and removed from the platen device 11 on its front side.

In the platen device 11, the platen 12 is a generally rectangular planar plate on which the printing portion of the work fabric is placed, and the auxiliary plate 15 has a generally pentagonal outer shape and is disposed below the platen 12. The frame structure 14 cooperates with the platen 12 and the auxiliary plate 15 to hold the work fabric, and the tray 13 is disposed below the platen 12 and the auxiliary plate 15 (and the frame structure 14 in the closed position of the platen device 11), and cooperates with the auxiliary plate 15 to define the accommodating space 13*a* for accommodating the portions of the work fabric that extend outwardly from the platen 12 when the work fabric is held by the platen 12, auxiliary plate 15 and frame structure 14.

The platen 12 and the generally pentagonal auxiliary plate 15 are fixed together with fixing pins 16 such that the auxiliary plate 15 are suspended from the platen 12 and such that an apex portion 31 (shown FIG. 4B) of the auxiliary plate 15 is located on the front side of the platen device 11. The apex portion 31 are defined by two mutually adjacent straight sides of the pentagon, which are inclined relative to each other such that an apex of the apex portion 31 has an obtuse angle. Each fixing pin 16 is screwed at its opposite ends in the lower surface of the platen 12 and the upper surface of the auxiliary plate 15. The auxiliary plate 15 is provided on its upper surface with a gripping portion in the form of two gripper bars 17 of circular shape in transverse cross section. These two gripper bars 17 are located at the respective front and rear ends of the auxiliary plate 15. The apex portion 31 provided at the front end of the auxiliary plate 15 facilitates the operator's manipulation to set the tubular work fabric such as the T-shirt 32 (shown in FIGS. 4A–4D) on the platen device 11 such that a printing portion of the tubular work fabric (e.g., front or bosom portion of the T-shirt 32) is held in direct contact with the upper surface of the platen 12 while a non-printing portion of the tubular fabric (e.g., back portion of the T-shirt 32) is located under the auxiliary plate 15 (in the accommodating space 13*a*). The apex portion 31 also functions as a positioning reference for accurate positioning of the work fabric on the platen device 11.

The frame structure 14 which cooperates with the platen 12 and the auxiliary plate 15 consists of a rectangular outer frame 18, a rectangular inner frame 19 and a knob portion 20. The outer frame 18 is hinged to support blocks 22 (which will be described) on its lower side (as viewed when the platen device 11 is in the open position as shown in FIG. 2) such that the outer frame 18 is pivotable relative to the platen 12. The inner frame 19 is located inside the outer frame 18 and supported on its right and left sides by the outer frame 18 such that the inner frame 19 is pivotable relative to the outer frame 19 about hinge pins 33 (shown in FIG. 6). The knob portion 20, which is fixed to the upper side (as seen in FIG. 2) of the outer frame 18, is gripped by the operator when the frame structure 14 is pivoted to open and close the platen device 11. The inner frame 19 is provided on the lower surfaces of its four sides with respective straight presser bars 21 functioning as an abutting portion which is brought into abutting contact with the upper surface of the auxiliary plate 15 through the work fabric, for thereby holding the work fabric, when the frame structure 14 is pivoted to close the platen device 11. The two presser bars 21 provided on the right and left sides of the inner frame 19 simply press the work fabric against the upper surface of the auxiliary plate 15, but the two presser bars 21 provided on the lower and upper (front and rear) sides of the inner frame 19 not only press the work fabric against the upper surface of the auxiliary plate 15 but also cooperate with the gripper bars 17 to grip or sandwich respective parts of the work fabric, as described below in detail by reference to FIGS. 5B and 5C. In this respect, it is noted that some kinds of work fabric such as the T-shirt 32 are expandable and shrinkable to a larger extent in the direction of their width than in the direction of their length. These kinds of work fabric can be suitably held by the present platen device 11, owing to the above-described arrangement wherein the right and left presser bars 21 simply press the work fabric against the auxiliary plate 15 while the front and rear presser bars 21 cooperate with the gripper bars 17 to apply a larger amount of tension to the work fabric in the direction of its length. When the frame structure 14 is in the closed position, in abutting contact with the auxiliary plate 15, the upper surface of the frame structure 14 is located below the upper surface of the platen 12, as indicated in FIG. 3, to effectively tension the work fabric and disturb printing movements of the printing head 5, affording an increased degree of freedom in determining the surface area of the work fabric in which a desired image is to be printed.

Under an assembly of the platen 12 and the auxiliary plate 15, there is fixedly disposed the tray 13 such that the tray 13 is supported at its lower surface by two parallel tray-support rods 23 fixed to its right and left end portions. As described above and as shown in FIG. 3, the tray 13 and the auxiliary plate 15 cooperate with each other to define the accommodating space 13*a* for accommodating the non-printing portions of the work fabric which extend downwards from the platen 12. The tray 13 has upwardly bent right and left side walls, as shown in FIG. 4C, so that the portions of the work fabric once accommodated in the accommodating space 13*a* are prevented from moving sideways out of the space 13*a* in the right and left directions, and are therefore prevented from interfering with the movable components of the ink-jet printer 1 and being stained. The above-indicated side walls define a width of the accommodating space as measured in a direction perpendicular to the direction of movement of the plate device 11 and a direction of thickness of the platen 12 and auxiliary plate 15.

Figure 3:
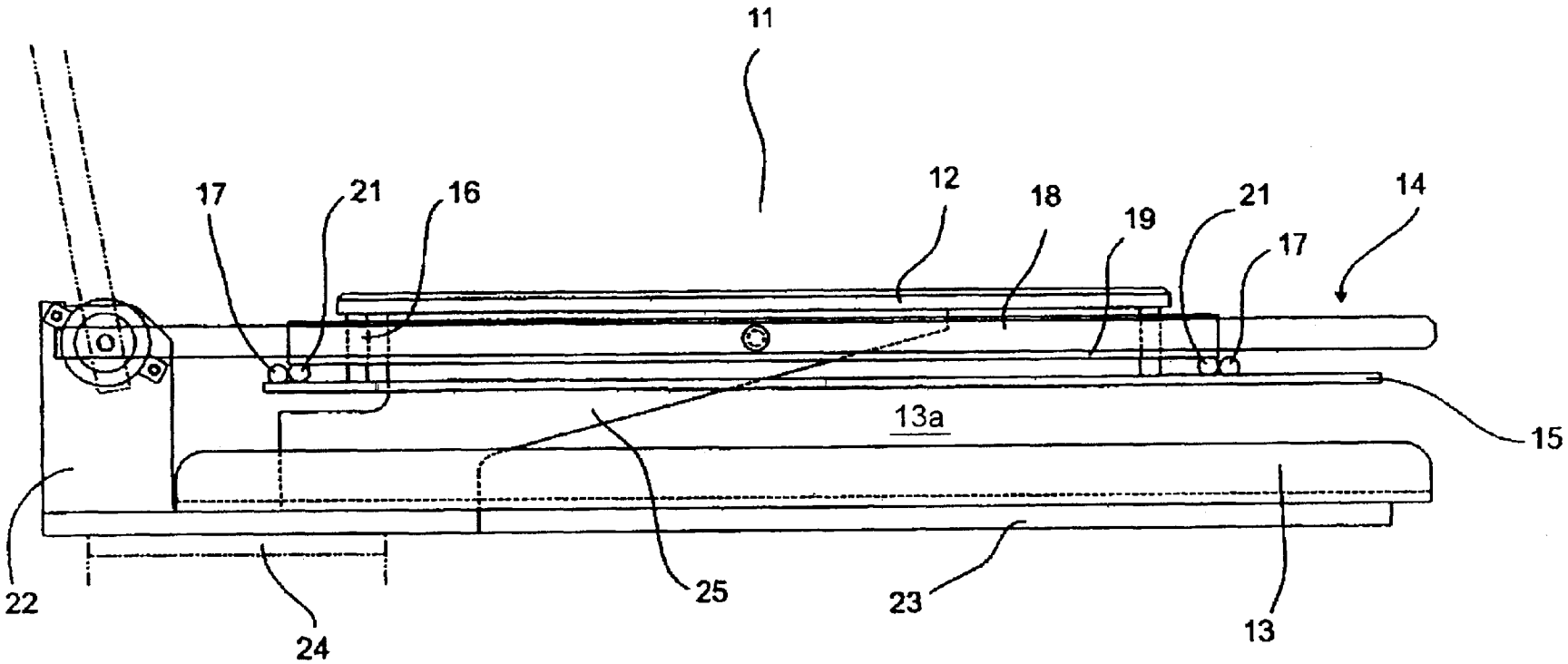
FIG. 3 is a left side elevational view of the platen device.

The platen device 11 further includes: support arms 25 supporting the assembly of the platen 12 and the auxiliary plate 15 in a cantilever fashion; two support blocks 22 arranged to pivotally support the outer frame 19 of the frame structure 14 at its lower end as seen in FIG. 2 (at its left end as seen in FIG. 3); and a base portion 24 to which are fixed the support blocks 22, the support arms 25 and the tray-support rods 23 are fixed. The support blocks 22 fixed to the upper surface of the base portion 24 provide pivot axes about which the frame structure 14 is pivoted or hinged. Thus, the platen 12, auxiliary plate 15, frame structure 14 and tray 13 which are major components of the platen device 11 are fixed together via the base portion 24.

Upon activation of the work-setting switch (not shown), the platen device 11 is sidably moved to and stopped at the work-setting position of FIG. 1. Then, the operator grips the knob portion 20, and upwardly pivot the frame structure 14 to place the platen device 11 in the open position. In this open position, the work fabric is set on the platen device 11. Where an annular or tubular work fabric in the form of a T-shirt is conventionally set, for example, the front (bosom) and back portions of the T-shirt are superposed on each other, so that the upper fabric layer (front or back portion) of the T-shirt tends to easily protrude upwards or crease, resulting in a failure to perform an intended printing operation on the selected portion of the work fabric, or a poor quality of the image printed with an ink delivered to the upper fabric layer. Further, the ink may permeate through the upper fabric layer into the lower fabric layer, resulting in staining of the printed T-shirt, as described above with respect to the prior art of the present invention.

Figure 4A:
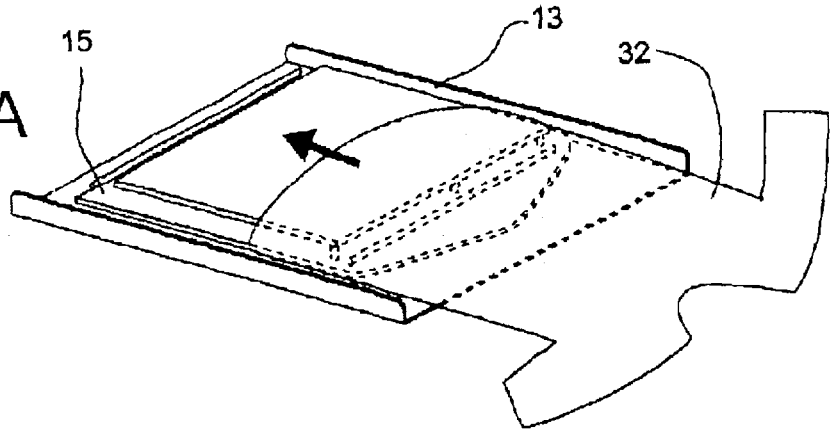
FIG. 4A is a perspective view showing a T-shirt in the process of setting on the platen device.
Figure 4B:
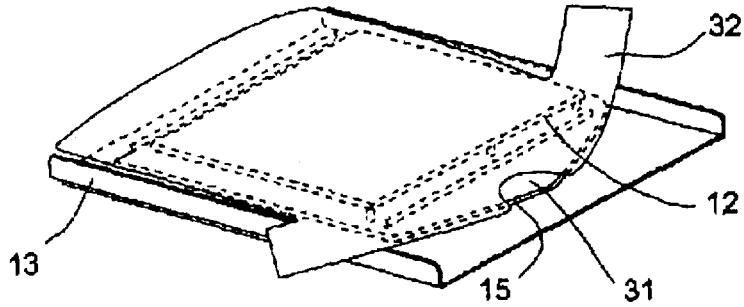
FIG. 4B is a perspective view showing the T-shirt which has been set on the platen device.
Figure 4C:
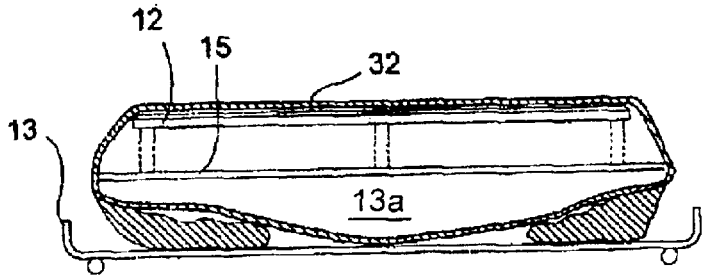
FIG. 4C is a front elevational view in transverse cross section of the platen device on which the T-shirt has been set.
Figure 4D:
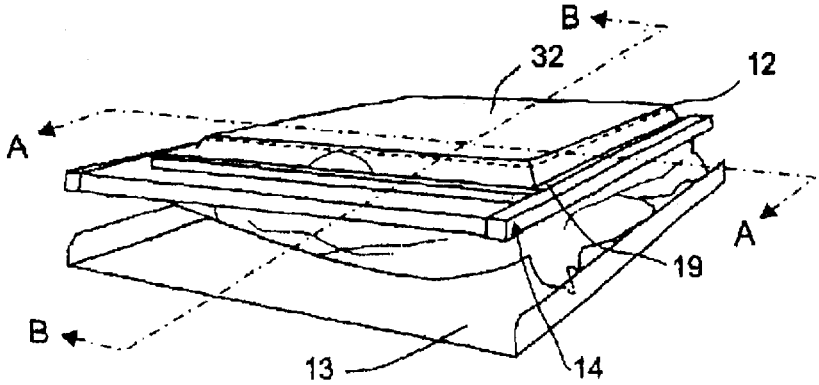
FIG. 4D is a perspective view of the platen device in its state in which a frame structure of the platen device is pivoted downwards to hold the T-shirt.

The platen device 11 constructed according to the present embodiment of this invention permits the tubular work fabric such as the T-shirt 32 to be set and held without the problems experienced in the prior art, as shown in FIGS. 4A–4D, such that a portion of the T-shirt 32 having a printing surface area in which an image is to be printed is held in contact with the upper surface of the platen 12 while another portion of the T-shirt 32 opposite to the above-indicated portion having the printing surface area is located under the auxiliary plate 15. FIG. 4A is a perspective view showing the T-shirt 32 in the process of setting on the platen device 11, and FIG. 4B is a perspective view showing the T-shirt 32 which has been set on the platen device 11. FIG. 4C is a front elevational view in transverse cross section of the platen device 11 on which the T-shirt 32 has been set, and FIG. 4D is a perspective view of the platen device 11 in its state in which the frame structure 14 is pivoted downwards to hold the T-shirt 32.

As shown in FIGS. 4A and 4B, the tubular T-shirt 32 is first oriented relative to the front portion of the assembly of the platen 12 and the auxiliary plate 15 such that the lower portion of the T-shirt 32 remote from the two sleeves is located nearer to the assembly and such that the sleeves extend sideways from the front and back portions. Then, the T-shirt 32 is moved relative to the assembly such that the front portion of the assembly is inserted into the tubular portion of the T-shirt 32, with the lower portion of the T-shirt 32 located on the rear side of the assembly, and such that the front portion (bosom) of the T-shirt 32 is in direct contact with the upper surface of the platen 12 while the back portion of the T-shirt 32 is located under the auxiliary plate 15, that is, within the accommodating space 13*a*, as shown in FIG. 4C. Thus, the non-printing back portion is opposed to and spaced apart from the printing front portion in the direction of thickness of the platen 12. The apex portion 31 of the substantially polygonal auxiliary plate 15 is located at the front end of the platen device 11, and cooperates with the adjacent inclined shoulder portions to facilitate the movement of the T-shirt 32 until the shoulder portions of the T-shirt 32 come into contact with the shoulder portions of the auxiliary plate 15. The inclined shoulder portions of the auxiliary plate 15 are rounded at their corner ends, to permit smooth movement of the T-shirt 32 without being caught on the corner ends.

The T-shirt 32 whose shoulder portions are in contact with the inclined shoulder portions of the auxiliary plate 15 is shown in FIG. 4B. In this state, the T-shirt 32 is positioned relative to the auxiliary plate 15 such that the center of the collar of the T-shirt 32 is aligned with the apex portion 31 of the auxiliary plate 15. The platen 12 and the auxiliary plate 15 are dimensioned and positioned relative to each other such that a central portion of the T-shirt 32 is almost aligned with a central portion of the platen 12 in the directions of width and length of the T-shirt 32, when the center of the collar of the T-shirt 32 is aligned with the apex portion 31, where the T-shirt 32 has an ordinary or standard size.

In the present embodiment, the support arms 25 provided to support the assembly of the platen 12 and the underlying auxiliary plate 15 in the cantilever fashion extend obliquely in the front upward direction from the base portion 24, as indicated in FIG. 3, so that the accommodating space 13a provided under the auxiliary plate 15 can be easily accessed for movement of the tubular portion of the T-shirt 32 by a sufficient distance toward the rear end of the platen device 11, so as to permit the front portion of the T-shirt 32 to be set in contact with the upper surface of the platen 12, without local floating or creasing of the front portion.

After the T-shirt 32 has been set in place on the assembly of the platen 12 and the auxiliary plate 15, as indicated in FIG. 4B, the back portion, hem portion, part of side portions and sleeve portions of the T-shirt 32 extending outwardly from the platen 12 are accommodated within the accommodating space 13*a* defined between the auxiliary plate 15 and the tray 13, as shown in FIG. 4C. If those portions of the T-shirt 32 were not accommodated within the space 13*a*, they would interfere with the main body portion of the printer 1 during sliding movement of the platen device 11, and/or the movable components of the printer 1 such as the printing head 5, giving rise to a risk of staining of those portions of the T-shirt 32, and a failure of the printer 1 with the T-shirt 32 partially caught by the movable components of the printer 1. The upwardly extending end walls of the tray 13 prevent the portions of the T-shirt 32 once accommodated in the space 13*a*, from being moved out of the space 13*a* beyond the vertical side walls. In this respect, the tray 13 is preferably formed of a transparent or translucent material such as an acrylic resin, to permit visual inspection of the portions of the T-shirt 32 within the accommodating space 13*a*, through the tray 13.

After the non-printing portions of the T-shirt 32 extending outwardly from the platen 12 have been accommodated in the space 13*a*, the frame structure 14 is pivoted downwards to close the platen device 11, so that the T-shirt 32 is held by the inner frame 19 of the frame structure 14 in cooperation with the assembly of the platen 12 and auxiliary plate 15, as shown in FIG. 4D, with a suitable amount of tension applied to the front portion of the T-shirt 32 held in contact with the platen 12, for maintaining the printing surface area in a flat state without a crease or slack.

Figure 5A:
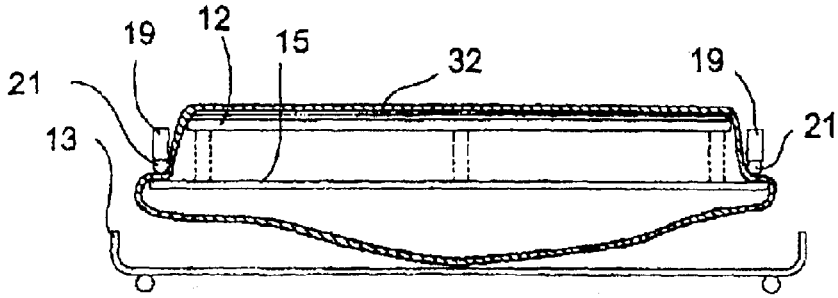
FIG. 5A is a cross sectional view taken along line A—A of FIG. 4D, showing an inner frame of the frame structure cooperating with a platen and an auxiliary plate to loosely hold the T-shirt at its widthwise opposite ends.
Figure 5B:
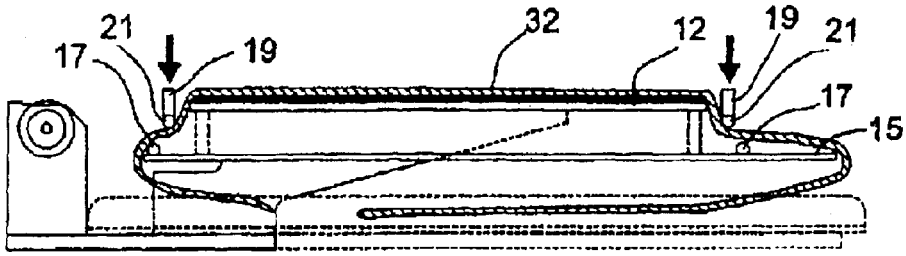
FIG. 5B is a cross sectional view taken along line B—B of FIG. 4D, showing the inner frame in the process of holding the T-shirt at its opposite longitudinal ends, in cooperation with the platen and auxiliary plate, while applying a tension to the T-shirt.
Figure 5C:
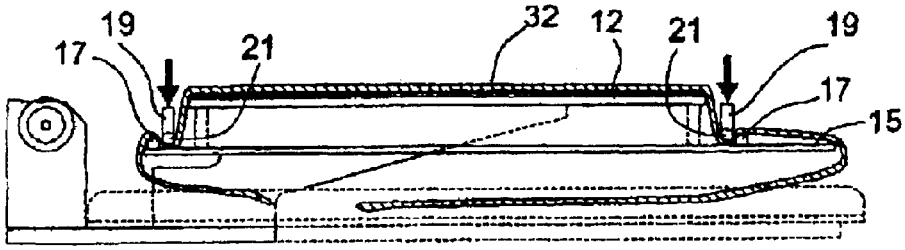
FIG. 5C is a cross sectional view showing the inner frame placed in its closed position in which the T-shirt has been held in position at its longitudinal ends.
Figure 5D:
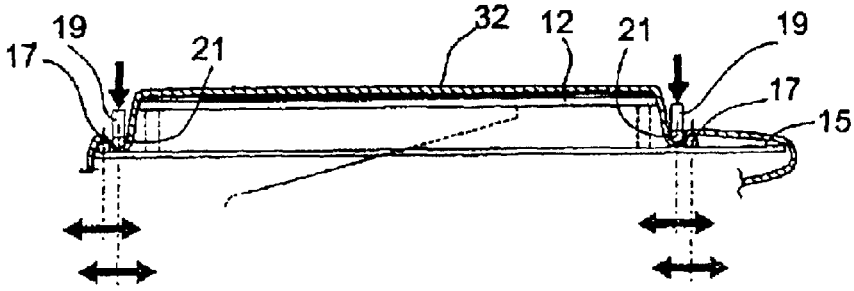
FIG. 5D is a cross sectional view showing an arrangement in which gripper bars or presser bars are adjustable in position in the longitudinal direction of the T-shirt.

The manner of holding the T-shirt 32 on the platen device 11 will be described in detail by reference to FIGS. 5A–5C. FIG. 5A is a cross sectional view taken along line A—A of FIG. 4D, showing that the round presser bars 21 provided on the lower surfaces of the right and left sides of the inner frame 19 of the frame structure 14 relatively loosely press the T-shirt 32 against the upper surface of the auxiliary plate 15, at the widthwise opposite ends of the T-shirt 32 whose front portion is held in contact with the upper surface of the platen 12. FIG. 5B is a cross sectional view taken along line B—B of FIG. 4D, showing a process in which the presser bars 21 provided on the lower surfaces of the front and rear sides of the inner frame 19 relatively loosely press the T-shirt 32 against the upper surface of the auxiliary plate 15 at its longitudinally opposite ends, in engagement with the respective gripper bars 17 fixed on the upper surface of the auxiliary plate 15, while applying a tension to the front portion of the T-shirt 32 set on the platen 12. FIG. 5C is a cross sectional view showing the T-shirt 32 which has been held in position at its longitudinal ends, with the front and rear presser bars 21 located inside and held in engagement with the gripper bars 17, after the process of FIG. 4C. FIG. 5D is a cross sectional view showing an arrangement in which the presser bars 21 or the gripper bars 17 are adjustable in position in the longitudinal direction of the T-shirt 32, for adjusting the amount of tension applied to the T-shirt 32 by the presser bars 21 and the gripper bars 17.

A work fabric such as the T-shirt 32 is generally more easily expandable and shrinkable in the direction of width than in the direction of length. This property of the fabric should be taken into account in holding the T-shirt 32 by application of a tension. If the T-shirt 32 is tensioned to the same extent in the directions of width and length, the amount of elongation of the T-shirt in the direction of its length is negligibly small but that in the direction of its width is considerably large. If the printing operation were performed on the T-shirt 32 in this condition, the printed T-shirt 32 would shrink in the width direction to its original width after removal of the T-shirt 32 from the platen device 11, so that the printed image would shrink in the width direction.

In view of a difference in elongation of the T-shirt 32 in the directions of width and length, the present platen device 11 is constructed so as to apply only a small amount of tension to the printed front portion of the T-shirt 32 in the width direction, and a relatively large amount of tension to the front portion in the length direction. Initially, the T-shirt 32 is set on the assembly of the platen 12 and the auxiliary plate 15 such that the front portion of the shirt 32 is in contact with the platen 12, without a crease in the printing surface area, while a most of the other portions of the shirt 32 is accommodated within the space 13*a* between the auxiliary plate 15 and the tray 13, as shown in FIG. 4C. Then, the frame structure 14 is downwardly pivoted to close the platen device 11 to hold the T-shirt 32, as shown in FIG. 3. In this closed position of the platen device 11, the weight of the frame structure 14 acts on the right and left presser bars 21 of the inner frame 19, and the right and left presser bars 21 come into abutting contact with the auxiliary plate 15 via the corresponding parts of the T-shirt 32. Since the T-shirt 32 is pressed by the right and left presser bars 21 against the auxiliary plate 15 with a force produced by the weight of the frame structure 14, substantially no tension is applied to the T-shirt 32 in the direction of width. Thus, the T-shirt 32 is held by the platen device 11, with substantially no elongation in the width direction.

However, the printing surface area of the front portion of the T-shirt 32 set on the platen 12 will have a crease if no tension is applied to the T-shirt 32. In view of this, the present platen device 11 is arranged to apply a suitable amount of tension to the T-shirt 32 in the direction of length, by engagement of the front and rear presser bars 21 of the inner frame 19 with the respective front and rear gripper bars 17 provided on the auxiliary plate 15, as shown in FIG. 5B, when the frame structure 14 is downwardly pivoted to close the platen device 11 after the most of the non-printing portions of the T-shirt 32 extending outwardly from the platen 12 are accommodated in the accommodating space 13*a* between the auxiliary plate 15 and the tray 13. The engagement of the front and rear presser bars 21 with the gripper bars 17 causes the corresponding parts of the T-shirts 32 to be gripped therebetween and lowered toward the upper surface of the auxiliary plate 15, whereby the T-shirt 21 is tensioned in the direction of length. The tension of the T-shirt 32 is maintained with the frame structure 14 held in its closed state for engagement of the front and rear presser bars 32 with the gripper bars 17, as shown in FIG. 5C, so that the T-shirt 32 is protected from being slackened.

It is desirable to maintain the frame structure 14 in the closed position such that the upper, surface of the frame structure 14 is located below the upper surface of the platen 12, that is, spaced a larger distance from the nozzles of the printing head 5 in the vertical direction than the upper surface of the platen 12, as well as to maintain the suitable amount of tension applied to the T-shirt 32 with the front and rear presser bars 21 downwardly pressing the T-shirt 32 in the closed position of the frame structure 14. The vertical position of the frame structure 14 in the closed state described above assures uniform application of the tension to the T-shirt 32 and prevents an interference or collision of the frame structure 14 with the printing head 5 during the movement of the platen device 11. Further, the vertical position of the frame structure 14 described above provides an increased freedom in determining the printing area on the T-shirt 32, since there are no obstacles to a relative movement between the platen device 11 and the printing head 5.

The platen 12 and the auxiliary plate 15 are formed of aluminum materials and are subjected to a plating treatment such as an electroless nickel plating for reducing the friction coefficient to facilitate the movement of the T-shirt 32 relative to the platen 12 and auxiliary plate 15 when the T-shirt 32 is set on the platen device 11. On the other hand, the presser bars 21 and gripper bars 17 provided for contact with the work fabric to hold and tension the work fabric are required to be formed of a material having a higher friction coefficient than the platen 12 and the auxiliary plate 15, and/or subjected to a surface treatment to increase the friction coefficient. The ink may permeate through the printing area of the T-shirt 32 and adhere to the platen 12, and the inner and outer frames 18, 19. For easy removal of the ink, those members are preferably formed of materials providing smooth surfaces, and/or subjected to a surface treatment to smooth the surfaces. The materials and surface treatment of the above-indicated members are not limited to those described above, but may be suitably selected as needed, depending upon the desired properties.

The positions of the front and left presser bars 21 of the inner frame 19, or the positions of the gripper bars 17 of the auxiliary plate 15 may be adjusted in the front and rear direction of the platen device 11, for permitting an adjustment of the tension to be applied to the T-shirt 32 in the direction of length, depending upon the specific thickness and material of the T-shirt 32. A suitable mechanism such as a mechanism using screws may be employed to adjust the positions of the front and rear presser bars 21 or the gripper bars 17.

Figure 6:
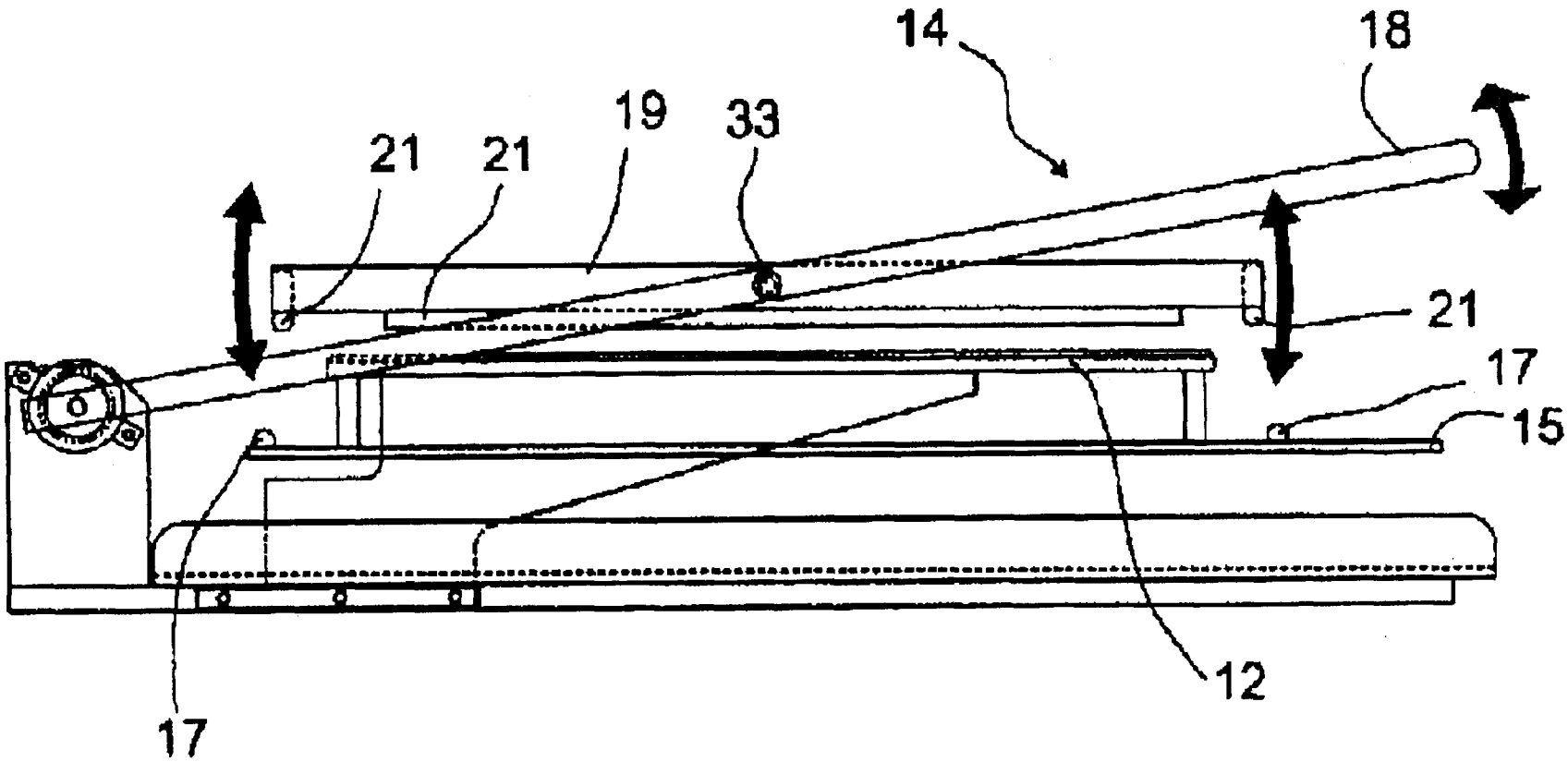
FIG. 6 is a side elevational view in cross section showing the frame structure including an outer frame and the inner frame pivotable relative to the outer frame, and further showing the platen and auxiliary plate which cooperate with the frame structure to hold the T-shirt.

Referring next to FIG. 6, there will be described a balance between front and rear gripping forces which are produced by engagement of the front and rear presser bars 21 and the respective gripper bars 17. This balance is important to assure a suitable amount of tension applied to the T-shirt 32. As shown in the elevational view of FIG. 6, the inner frame 19 is pivotable relative to the outer frame 18 when the frame structure 14 is pivoted relative to the assembly of the platen 12 and the auxiliary plate 15. The inner frame 19 pivotally connected to the outer frame 18 makes it possible to establish the balance between the front and rear gripping forces described above. Discussed in detail, the T-shirt 32 is tensioned in the direction of length, by gripping the T-shirt 32 on the front and rear sides of the platen device 11, as described above, for holding the T-shirt 32 without a crease or slack of the front portion set on the platen 12, or for preventing the T-shirt 32 from being slackened during a printing operation performed thereon. However, a difference between the front and rear gripping forces acting on the T-shirt 32 may cause the T-shirt 32 to be merely moved in the frontward or rearward direction, making it impossible to apply a suitable amount of tension to be applied to the T-shirt 32, and giving rise to a risk of creasing or slackening of the T-shirt 32.

To prevent the drawback indicated above, the inner frame 19 is pivotally connected to the outer frame of the frame structure 14 such that the inner frame 19 is pivotable about the hinge pins 33 relative to the outer frame 18. This arrangement permits the inner frame 19 to be maintained in the horizontally extending attitude irrespective of the angle of the outer frame 18 with respect to the upper surface of the auxiliary plate 15, when the presser bars 21 of the inner frame 19 come into pressing contact with the T-shirt 32 during a downward pivoting movement of the frame structure 14. As a result, the front and rear presser bars 21 can be substantially concurrently brought into engagement with the respective gripper bars 17 via the T-shirt 32, whereby the T-shirt 32 can be gripped by the front and rear presser bars 21 and the respective gripper bars 17, with almost equal gripping forces, so that the T-shirt 32 can be suitably tensioned in the direction of its length.

Figure 7A:
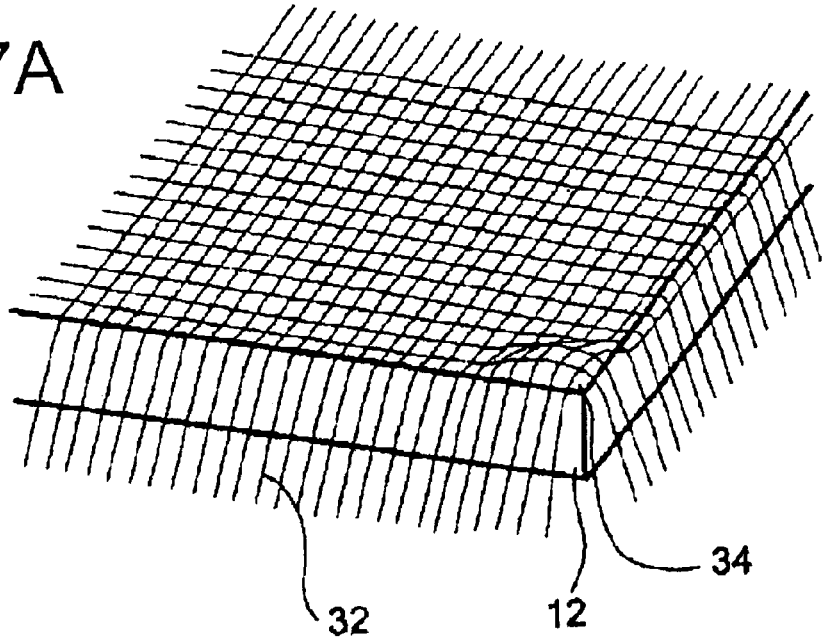
FIG. 7A is a wire-frame view indicating a state of the T-shirt set on the platen where the platen has sharp corner edges.

The work fabric may crease or slacken at the corner portions of the platen 12, depending upon the geometry of the corner portions of the platen 12, as described below by reference to FIGS. 7A and 7B. The wire-frame view of FIG. 7A indicates a state of the T-shirt 32 set on the platen 12 where the platen 12 has sharp corner edges, while the wire-frame view of FIG. 7B indicates a state of the T-shirt 32 set on the platen 12 where the corner portions of the platen 12 are chamfered or rounded. Where each corner 34 of the platen 12 defined by the three mutually perpendicular edges is not chamfered or rounded, the fabric of the T-shirt 32 tends to float apart from the upper surface of the platen 12 and have a crease at the sharp corner 34, due to a sudden change in the tension at the local portion adjacent to the sharp corner 34. The thus generated crease may cause creasing of the central printing surface area in the front portion of the T-shirt 32 placed on the platen 12, giving rise to a risk of poor quality of the image printed in the printing surface area, and/or detection of the crease as an obstacle by a sensing device described below, which prevents a printing operation of the printing head 5. Similar problems may take place where the presser bars 21 and the gripper bars 17 are unnecessarily long and cause unnecessarily large forces acting on the corner 34 and application of an unnecessarily large tensile force at the corner 34 when the frame structure 14 is downwardly pivoted to close the platen device 11.

Figure 7B:
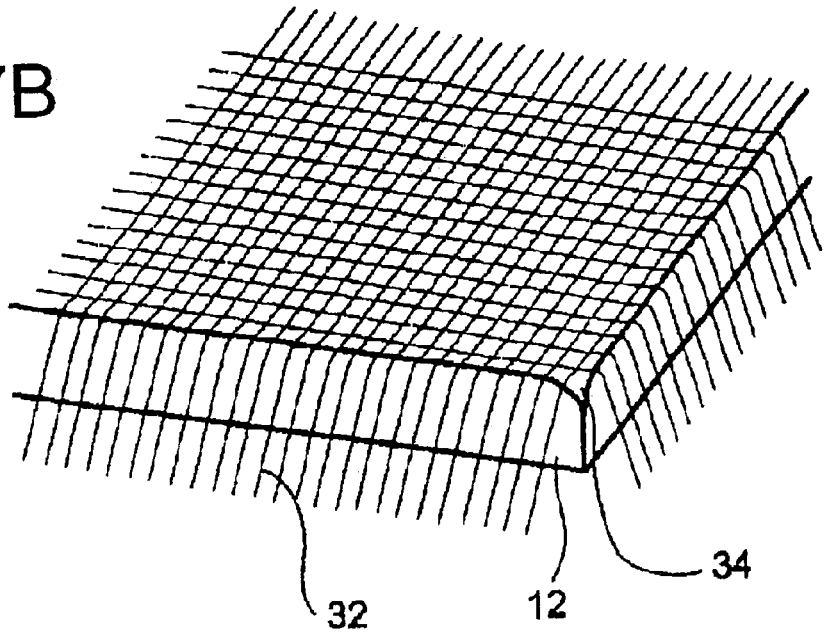
FIG. 7B is a wire-frame view indicating a state of the T-shirt set on the platen where the corner portions of the platen are chamfered or rounded.

To solve the problems indicated above, each corner 34 of the platen 12 is chamfered by a suitable amount as indicated in FIG. 7B, to reduce the sudden change in the tension near the corner 34, making it possible to minimize the local floating and creasing of the work fabric at the corner 34, which would disturb the printing operation. Further, the lengths of the presser bars 21 and the gripper bars 17 are determined so as not to intersect each other at a position below each corner 34, for minimizing a possibility of the unnecessarily large tension at the corner 34.

Thus, the platen device 11 of the present embodiment is constructed and arranged to permit easy and accurate setting of the tubular work fabric such as the T-shirt 32 such that the portion of the work fabric having the printing surface area is placed in contact with the upper surface of the platen 12, without floating or creasing of the printing surface area. It will be understood that the platen device of the present invention is not limited to the construction and arrangement in the illustrated embodiment described above, but may be modified as needed depending upon the specific configuration of the ink-jet printer and the specific kind of the work fabric to be printed, without departing from the spirit of the present invention.

Although the manner of holding the tubular work fabric in the form of the T-shirt 32 on the platen device 11 has been described above, it is to be understood that the platen device 11 can hold any kind of workpiece including a non-annular or non-tubular workpiece as well as a tubular workpiece, such that a portion of the workpiece which has a printing surface area is held in direct contact with the upper surface of the platen 12. It is also to be understood that the platen device of the present invention can hold any tubular workpiece other than a T-shirt, for example, a sleeveless shirt, a cap and a hat. The term "tubular workpiece" is interpreted to mean a workpiece (e.g., work fabric) including at least one annular or tubular portion, such as a body portion (including front and back portions) and sleeves of the T-shirt. It is also noted that a non-tubular workpiece such as an apron includes a tubular portion such as a pocket which includes at least two fabric layers. The platen device of the present invention can be conveniently used to hold such a tubular portion of the non-tubular workpiece when a desired image is printed on the tubular portion. The workpiece need not be a fabric, and may be formed of any material that accepts an ink.

Figure 8A:
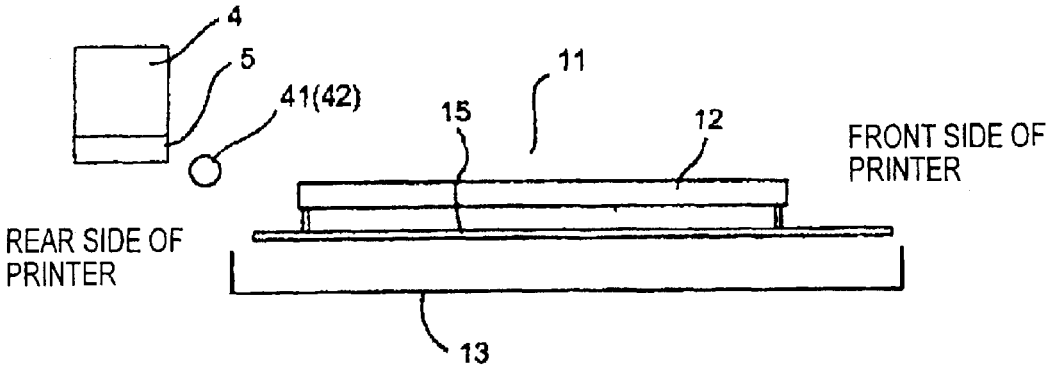
FIG. 8A is a left side elevational view showing a positional relationship among a printing head, a light-emitting unit, and the platen device of the ink-jet printer of FIG. 1.
Figure 8B:
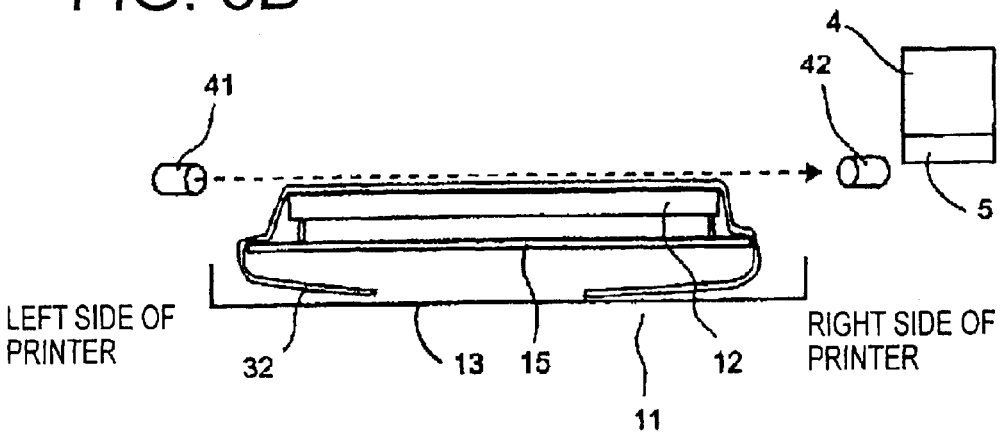
FIG. 8B is a front elevational view of the printer.
Figure 8C:
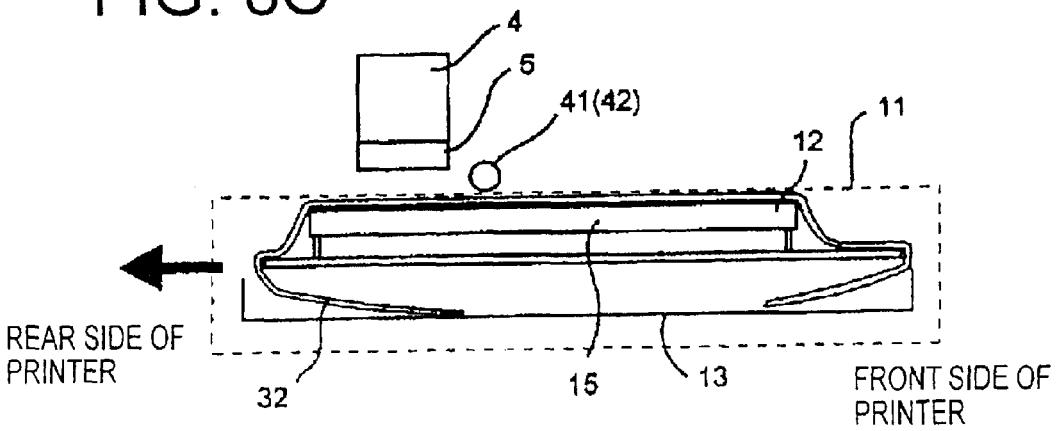
FIG. 8C is a left side elevational view of the printer during a movement of the platen device relative to the printing head.

Referring next to FIGS. 8A, 8B and 8C, there will be described a sensing device arranged to detect any obstacle which would disturb a printing operation on the printing surface area of the work fabric, deteriorate a quality of an image printed in the printing surface area, or interfere with or damage the printing head 5. The obstacle includes a raised or floating portion in the printing surface area of the work fabric, a crease in the printing surface area, and anything left or placed in the printing surface area. As shown in FIG. 1, the present ink-jet printer 1 includes the sensing device which includes a light-emitting unit 41 and a light-receiving unit 42 and which is located between the printing head 5 and the rear end of the platen device 11, as viewed in the direction of movement of the platen device 11, when the platen device 11 is located at its work-setting position of FIG. 1. The two units 41, 42 are attached to respective holder frames fixed on the table of the main body of the printer 1.

There will be described a positional relationship between the sensing device 41, 42 and the related components of the printer 1, by reference to FIGS. 8A, 8B and 8C. FIG. 8A is a left side elevational view showing a positional relationship among the printing head 5, the light-emitting unit 41, and the platen device 11, and FIG. 8B is a front elevational view of the printer 1, while FIG. 8C is a left side elevational view of the printer 1 during a movement of the platen device 11 relative to the printing head 5 from the work-setting position to the printing-start position. As shown in FIG. 8A, the light-emitting unit 41 is attached to the corresponding holder frame such that the light-emitting unit 41 is located between the printing head 5 mounted on the carriage 4, and the rear end of the platen device 11, in the direction of movement of the platen device 11 between the work-setting position and the printing-start position.

As shown in FIG. 8B, the light-emitting and light-receiving units 41, 42 are spaced part from each other in the direction of movement of the printing head 5, that is, in the direction perpendicular to the direction of movement of the platen device 11. The two units 41, 42 are positioned relative to the platen device 11 such that the platen device 11 is interposed between the two units 41, 42 in the direction of movement of the printing head 5, with a suitable spacing between each unit 41, 42 and the corresponding left or right end of the platen device 11. The light-emitting unit 41 is arranged to emit a light beam, and the light-receiving unit 42 is located at the same position as the light-emitting unit 41 in the direction of movement of the platen device 11, and is arranged to receive the light beam emitted by the light-emitting unit 41. As shown in FIG. 8B, the two units 41, 42 are located between the lower surface of the printing head 5 and the upper printing surface of the work fabric (T-shirt 32) set on the platen 12, in the vertical direction. The sensing device including the two units 41, 42 is capable of detecting any obstacle which exists between the printing surface of the work fabric and the lower surface of the printing head 5 and which may interfere with the printing head or otherwise cause a trouble in operation of the printer 1. As described above, the obstacle may be a relatively large amount of creasing, local upward protrusion or floating of the work fabric (T-shirt 32), and/or any object which is left on the printing surface of the work fabric during setting of the work fabric on the platen device 11 or dropped on the printing surface during a printing operation of the printer 1. The obstacle may deteriorate the quality of the printed image, collide or interfere with the printing head 5, or even deteriorate or damage the printing head 5 due to the obstacle caught between the lower surface of the printing head 5 and the work fabric (platen 12).

The detection of any obstacle on the work fabric is effected during the movement of the platen device 11 from the work-setting position of FIG. 1 to the printing-start position after the work fabric such as the T-shirt 32 has been set on or held by the platen device 11, as shown in FIG. 8C. If any obstacle is detected by the sensing device 41, 42, a signal is fed from the sensing device to a control device of the printer 1, and the control device commands the printer 1 to immediately stop the movement of the platen device 11. Accordingly, a printing operation is not performed by the printer 1 in the event of detection of any obstacle, so that the work fabric is prevented from being subjected to an inadequate printing operation. Alternatively, the control device commands the printer 1 to not only immediately stop the movement of the platen device 11, but also return the platen device 11 back to the work-setting position. This arrangement eliminates an operator's manipulation to return the platen device 11 to the work-setting position for rectifying the setting of the work fabric, for example. As is apparent from FIG. 8C, an obstacle if any on the printing surface of the work fabric can be detected before the obstacle reaches a position right under the printing head 5. This arrangement permits stopping of the platen device 11 or returning of the platen device 11 to the work-setting position before the obstacle reaches the position of the printing head 5, so that the printing head 5 is protected from damaging due to a collision with the obstacle.

The sensing device used in the present embodiment is a light-transmission type sensing device arranged to detect an obstacle when the light beam emitted by the light-emitting unit 41 toward the light-receiving unit 42 is interrupted by the obstacle. However, the use of the light-transmission type sensing device is not essential to practice the method of detecting the obstacle, and any other suitable sensing device such as a light-reflection type sensor may be used to detect the obstacle.

In the present embodiment, the assembly of the platen 12 and the auxiliary plate 15 suspended from the platen 12 is supported by the support arms 25 which extend from the base portion 24 obliquely in the front upward direction. To deal with various sizes of tubular workpieces to be printed on the present ink-jet printer 1, both of the platen 12 and the auxiliary plate 15 must be changed depending upon the specific size of the workpiece. Since these platen 12 and auxiliary plate 15 are constructed as a unitary assembly, that is, since the platen 12 and auxiliary plate 15 can be removed and installed at one time, the presently used assembly can be replaced with a desired one in a short time. When the new assembly of the platen 12 and auxiliary plate 15 is installed, the inner frame 19 of the frame structure 14 is also changed to the one that suits the specific size of the presently installed assembly of the platen 12 and auxiliary plate 15. Alternatively, the frame structure 14 may be changed as a whole. Thus, the workpieces of various sizes can be held by the present platen device 11.

What is claimed is:

1. A platen device for holding a workpiece in an ink-jet printer operable to perform a printing operation on a printing surface of the workpiece, said platen device being movable into a printing area in which a printing head is operated to deliver an ink onto said printing surface for thereby forming an image on said printing surface, said platen device comprising:

a platen arranged to permit said workpiece to be placed on said platen such that a printing portion of said workpiece having said printing surface is in direct contact with a surface of said plate;

a space-defining structure partially defining an accommodating space which is provided below said platen to accommodate non-printing portions of said workpiece which extend from said printing portion outwardly of said platen;

a base on which said platen is fixedly disposed; and a frame structure cooperating with said platen to hold said workpiece while applying a tension to said printing portion of said workpiece;

wherein said frame structure includes an outer frame pivotally connected to said base at one end of said base, such that said outer frame is pivotable so that said frame structure is pivotable between an open position and a closed position, said frame structure further including an inner frame disposed inside said outer frame and pivotable relative to said outer frame, said frame structure and said platen being positioned relative to each other such that said inner frame comes into contact with said printing portion of said workpiece when said frame structure is pivoted to said closed position.

2. A platen device according to claim 1, wherein said space-defining structure partially defines said accommodating space such that said accommodating space can accommodate a part of a non-printing portion of said workpiece which extends from said printing portion in direct contact with said surface of said platen and which cooperates with said printing portion to form a tubular portion of said workpiece, said platen being arranged to permit said workpiece to be positioned relative to said platen and said accommodating space such that said part is spaced by at least said platen from said printing portion in a direction of thickness of said platen.

3. A platen device according to claim 2, further comprising a support structure which supports said platen in a cantilever fashion such that said platen is supported at one end portion thereon on the side of said printing area, and is not supported at the other end portion.

4. A platen device according to claim 1, wherein said frame structure and said platen are positioned relative to each other such that an upper surface of said frame structure is spaced apart from said surface of said platen in a direction away from a surface of said printing head from which said ink is delivered, when said frame structure is placed in said closed position in which said frame structure cooperates with said platen to hold said workpiece.

5. A platen device according to claim 1, wherein said inner frame is provided with an abutting portion which comes into contact with said workpiece when said frame structure is pivoted to said closed position.

6. A platen device according to claim 5, wherein said abutting portion is absent at each corner portion of said inner frame.

7. A platen device according to claim 5, wherein said inner frame has at least three sides, and said abutting portion consists of at least three elongate presser members which extend along said at least three sides, respectively.

8. A platen device according to claim 7, wherein said inner frame is a rectangular frame having four sides, and said at least three elongate presser members consist of four straight presser bars extending along said four sides, respectively.

9. A platen device according to claim 5, wherein said space-defining structure includes an auxiliary plate which is disposed below said platen and which partially defines said accommodating space on one side thereof remote from said platen, said abutting portion pressing said workpiece against a surface of said auxiliary plate when said frame structure is pivoted to said closed position.

10. A platen device according to claim 9, wherein said auxiliary plate is fixed to said platen such that said platen an said auxiliary plate constitute a unitary assembly.

11. A platen device according to claim 10, wherein said auxiliary plate is suspended from said platen.

12. A platen device according to claim 9, wherein said auxiliary plate has a generally pentagonal outer shape defined by five generally straight sides including two mutually adjacent sides which are inclined relative to each other so as to define an apex portion which has an obtuse angle and which is located at one end of said auxiliary plate as seen in a direction of movement of said platen device relative to said printing head, said one end of said auxiliary plate being remote from said printing area in said direction of movement.

13. A platen device according to claim 9, wherein said space-defining structure further includes a tray which cooperates with said auxiliary plate to define said accommodating space therebetween.

14. A platen device according to claim 13, wherein said tray has opposite side walls which extend in a direction of thickness of said platen and said auxiliary plate and which define a width of said accommodating space as measured in a direction perpendicular to said direction of thickness and a direction of movement of said platen device relative to said printing head.

15. A platen device according to claim 9, wherein said auxiliary plate has a gripping portion which is provided on said surface and which cooperates with said abutting portion to grip a part of said workpiece, when said frame structure is pivoted to said closed position, said part being located outside said surface of said platen.

16. A platen device according to claim 15, wherein said gripping portion consists of elongate gripper members provided at opposite end portions of said surface of said auxiliary plate, which opposite end portions are spaced apart from each other in a direction of movement of said platen device relative to said printing head, said frame structure being pivotable at one end thereof as seen in said direction of movement.

17. A platen device according to claim 16, further comprising an adjusting mechanism arranged to adjust a relative position between said elongate presser members and said elongate gripper members, in said direction of movement, for adjusting a tension to be applied to said printing portion of said workpiece.

18. A platen device according to claim 15, wherein said abutting portion of said inner frame and said gripping portion of said auxiliary plate have a higher coefficient of friction than those of said platen and said auxiliary plate.

19. A platen device according to claim 9, wherein said platen, said frame structure and said auxiliary plate are formed of aluminum and are finished by a surface treatment by plating.

20. A platen device according to claim 1, wherein said platen has chamfered corner portions partially defined by said surface thereof for contact with said printing portion of said workpiece.

21. A platen device for holding a workpiece in an ink jet printer operable to perform a printing operation on a printing surface of the workpiece, said platen device being movable into a printing area in which a printing head is operated to deliver an ink onto said printing surface thereby forming an image on said printing surface, said platen device comprising:

a platen arranged to permit said workpiece to be placed on said platen such that a printing portion of said workpiece having said printing surface is in direct contact with a surface of said platen; and a space defining structure partially defining an accommodating space which is provided below said platen to accommodate non-printing portions of said workpiece which extend from said printing portion outwardly of said platen;

wherein said platen constitutes a part of a unitary assembly, and said space-defining structure includes said unitary assembly and a lower member which is disposed below said unitary assembly and which cooperates with said unitary assembly to define said accommodating space, and said unitary assembly having a surface which is parallel to and located below and outwardly of said surface of said platen and which supports one of said non-printing portions of said workpiece which is located adjacent to said printing portion.

22. A platen device according to claim 21, wherein said lower member is a tray having opposite side walls which extend in a direction of thickness of said unitary assembly and which defines a width of said accommodating space as measured in a direction perpendicular to said direction of thickness and a direction of movement of said platen device relative to said ink-jet printer, said width of said accommodating space being larger than a width of said unitary assembly.

23. A platen device for holding a workpiece in an ink-jet printer operable to perform a printing operation on a printing surface of the workpiece, said platen device being movable into a printing area in which a printing head is operated to deliver an ink onto said printing surface for thereby forming an image on said printing surface, said platen device comprising:

a platen arranged to permit said workpiece to be placed on said platen such that a printing portion of said workpiece having said printing surface is in direct contact with a surface of said platen;

a space-defining structure partially defining an accommodating space which is provided below said platen to accommodate non-printing portions of said workpiece which extend from said printing portion outwardly of said platen; and a frame structure cooperating with said platen to hold said workpiece while applying a tension to said printing portion of said workpiece, when said frame structure is operated to a workplace holding position thereof;

wherein said frame structure includes at least one pivotable member each of which is pivotable relative to said surface of said platen, about an axis parallel to said surface of said platen, said frame structure and said platen being positioned relative to each other such that said frame structure comes into contact with said workpiece when said frame structure is operated to said workpiece holding position.

24. A platen device according to claim 23, wherein said at least one pivotable member includes a pivotable member pivotable about an axis located outside said surface of said platen as seen in a plane parallel to said surface, so that said frame structure is pivotable between an open position, and a closed position as said workpiece holding position.

25. A platen device according to claim 23, where said at least one pivotable member includes a first pivotable member pivotable about a first axis located outside said surface of said platen as seen in a plane parallel to said surface, so that said frame structure is pivotable between an open position, and a closed position as said workpiece holding position, and a second pivotable member pivotable relative to said first pivotable member about a second axis which is parallel to said first axis and located inside said surface of said platen as seen in said plane, said second pivotable member being brought into contact with said workpiece when said first pivotable member is pivoted to said closed position.

* * * * *